US005803258A

United States Patent [19]

Gonzalez-Rivera

[11] Patent Number: 5,803,258

[45] Date of Patent: Sep. 8, 1998

[54] SYSTEM FOR HOLDING FRAGILE ITEMS

[75] Inventor: Ani Gonzalez-Rivera, Sea Cliff, N.Y.

[73] Assignee: Archival Matters, Inc., Sea Cliff, N.Y.

[21] Appl. No.: 799,780

[22] Filed: Feb. 12, 1997

[51] Int. Cl.[6] ..... B65D 85/48

[52] U.S. Cl. ..... 206/454; 206/594

[58] Field of Search ..... 206/449, 454, 206/455, 456, 521, 591, 592, 594

[56] References Cited

U.S. PATENT DOCUMENTS

| | | | |
|---|---|---|---|
| 2,746,667 | 5/1956 | Murphy . | |
| 3,655,034 | 4/1972 | Stollman et al. . | |
| 3,735,952 | 5/1973 | Platus et al. . | |
| 4,030,603 | 6/1977 | Angell . | |
| 4,373,643 | 2/1983 | Przytarski . | |
| 4,478,331 | 10/1984 | Ruin . | |
| 4,664,254 | 5/1987 | Sitwell et al. . | |
| 4,763,789 | 8/1988 | Questel et al. | 206/454 |
| 4,852,743 | 8/1989 | Ridgeway . | |
| 4,865,200 | 9/1989 | Sullivan et al. | 206/594 X |
| 4,919,277 | 4/1990 | Jeruzal . | |
| 5,259,523 | 11/1993 | Scherb . | |
| 5,285,902 | 2/1994 | Tabuenca . | |
| 5,429,240 | 7/1995 | Biebel et al. . | |
| 5,518,118 | 5/1996 | Pütz et al. . | |
| 5,655,662 | 8/1997 | Garcia . | |

OTHER PUBLICATIONS

David Erhardt, "Art in Transit: Material Conditions," *International Conference on the Packaging and Transportation of Paintings,* (London, 1991). 25–36.

Timothy Green, "A Cushioned Transit Frame for Paintings," *International Conference on the Packaging and Transportation of Paintings,* (London, 1991). 37–48.

Paul J. Marcon, "A Circular Slide Rule for Protective Package Design," *International Conference on the Packaging and Transportation of Paintings,* (London, 1991). 93–106

Paul J. Marcon, "Shock, Vibration, and Protective Package Design," *International Conference on the Packaging and Transportation of Paintings,* (London, 1991). 107–120.

Stephen Hackney and Paul J. Marcon, "Package Case Design," *International Conference on the Packaging and Transportation of Paintings,* (London, 1991). 69–77.

*Primary Examiner*—Jacob K. Ackun

*Attorney, Agent, or Firm*—Hoffmann & Baron, LLP

[57] ABSTRACT

A system for holding a fragile item includes a support panel which is dimensionally suitable for receiving the fragile item and has at least one opening passing therethrough. The system also includes at least one fastening device for selectively securing the fragile item to the support panel. The fastening device includes a fastener member, a fastener securing member and an item-attachment member. The fastener member has first and second end portions whereby the first end portion is formed to pass through the at least one opening in the support panel. The fastener securing member is formed to engage the first end portion of the fastener member so that the fastener member is retained in the support panel after being passed through the at least one opening of the support panel. The item-attachment member is fixed to the fragile item and has an opening formed therein permitting the second end portion of the fastener member to pass therethrough when aligned therewith and prevents the second end portion from passing therethrough when not aligned therewith. The fragile item is selectively secured to the support panel by aligning the second end portion of the fastener member with the opening in the item-attachment member so that the second end portion passes through the opening and, upon rotating the second end portion, the second end portion is not aligned with the opening thereby retaining the second end portion in the item-attachment member so that the fragile item may be shipped or stored on the support panel.

40 Claims, 17 Drawing Sheets

SYSTEM FOR HOLDING FRAGILE ITEMS

BACKGROUND OF THE INVENTION

1. Field of the Invention

The present invention relates to systems for holding items and more particularly, relates to systems for holding fragile items such as artwork and historical objects.

2. Description of the Prior Art

It is known that the safe handling of fragile items such as works of art, e.g., paintings, tapestries and sculptures, etc., during transport to and from studios and/or exhibits is a major concern of the owners of such pieces of artwork. Similar concern exists among owners of historical objects which must, at times, also be transported between various locations. Due to the fragile nature of these items and, in most cases, the high value associated with them, much time and money is expended in providing systems that are intended to sufficiently protect the items during shipping and handling.

For instance, several methods and systems for transporting paintings have been employed in the prior art. One approach involves constructing a custom shipping frame and custom transport crate for each individual painting from a material such as wood. Each frame is typically handmade and sized to fit the single painting which will reside therein during shipping. The shipping frame is attached to a painting frame (e.g., canvas stretcher upon which the painting, itself, is mounted) via mounting hardware such as nuts and bolts. However, while such approach attempts to ensure a properly fitted shipping container for the valuable item, such an approach has several disadvantages. For instance, it is known that during unpacking of the painting from the custom frame, the loose mounting hardware may be accidentally dropped on the painting causing damage to the painting. Further, the time to construct a custom shipping frame and transport crate becomes severely prohibitive when a large number of paintings are to be transported. The time necessary to attach each object to its respective shipping frame is prohibitive and not cost effective. Because each custom shipping frame is constructed for one particular object, the reuse of such a shipping frame and crate is severely limited; modification and adjustments for reuse by other objects is not time or cost effective. Since construction of the frame is wood, this natural resource is depleted and only minimally recyclable. Furthermore, a wood frame creates off-gassing, which prevents objects from being permanently stored therein. Also, the weight of the wood shipping frame adds substantially to the overall freight costs, especially for large exhibitions. In addition, the wood shipping frame transfers all shock and vibration directly to the object when said object is being handled in storage or being prepared for shipment or display. Again, while the preservation of the artwork is of paramount concern, the high cost and lengthy time associated with constructing multiple custom shipping frames for each painting is prohibitive.

Another approach which attempts to address the issue of reusability of shipping containers for artwork is disclosed in U.S. Pat. No. 5,285,902 to Tabuenca Garcia. Particularly, the '902 patent discloses a packaging system for paintings and other works of art which includes a metal tubular frame with a series of belts attached thereto. The belts are tensioned between buckles such that each belt forms a flat ring inside which a painting is accommodated. The painting is fastened by a series of half-clamps which are mounted on the belts and which attach to the sides of the painting with the belts criss-crossing over the surface of the painting. The metal tubular frame, with the painting supported therein, is then placed in matching receptacles within a custom transport vehicle on vibration-insulating supports. This approach allows for reuse of the packaging system each time the painting is transported and also permits varying sized paintings to be accommodated by adjusting the belts and clamps. However, the packaging system is flawed in that the belts tend to loosen and then rub against the artwork causing damage. Also, the artwork is subjected to stress and shaking when the belts are being initially tightened around it during packing. Still further, while the belt fastening approach may conserve time as compared to the custom frame approach, the time to properly position the painting within the frame and adjust all the belts is severely prohibitive when dealing with a large number of artwork pieces. The tightening and adjustment of the belts requires experienced personnel to direct these activities. The tubular frame and belts is limited to only square framed objects; odd shaped objects require having an additional shipping frame built (from wood), so the belts can be positioned therein. Because the tubular frame must travel within a matching metal transport crate, the weight of the combination frame and crate is more than a conventional wood crate, so the shipping cost is greater, and can be prohibitive with large exhibitions.

Accordingly, there is a need for a system for holding (i.e., shipping, storing and/or handling) fragile items such as artwork and historical objects which sufficiently protects such items during shipping, handling and storage and which is both reusable and time efficient. Also, there is a need for a system for shipping, handling and storing fragile items which includes fastening means which does not come directly into contact with the fragile item and which is captive, rather than loose, so that there is no risk of mishandled loose mounting hardware damaging the items during packing and unpacking. Still further, there is a need for a system for shipping, handling and storing fragile items which accommodates a larger variety of items having varied sizes and shapes including, for example, both substantially flat and substantially non-flat objects.

Thus, the present invention is directed toward overcoming the disadvantages of conventional artwork shipping systems, some of which have been discussed above, and towards satisfying the needs existing in the prior art.

OBJECTS AND SUMMARY OF THE INVENTION

It is an object of the present invention to provide systems for holding fragile items which permits shipping, handling and storing of a plurality of fragile items within a single container.

It is a further object of the present invention to provide systems for holding fragile items which permits shipping, handling and storing of fragile items having varied dimensional profiles including both substantially flat and substantially non-flat objects.

It is yet another object of the present invention to provide systems for holding fragile items which employs captive mounting hardware.

It is still a further object of the present invention to provide a secure and efficient means of viewing enclosed objects in storage, while at the same time protecting said objects from air-borne pollutants, water, or other liquid.

It is still a further object of the present invention to provide a simple method for tracking and monitoring the interior environment of an enclosed object, by means of utilizing a digital temperature/humidity data logger, which can be retrieved for reading and monitoring via a PC, the interior temperature and humidity levels of the enclosed container, before, during, or after transportation, or storage.

It is still a further object of the present invention to provide systems for holding fragile items including a single container which is sufficiently strong to protect the items contained therein from damaging forces and elements.

It is yet another object of the present invention to provide systems for holding fragile items which includes means for isolating the fragile items from vibrations.

It is still a further object of the present invention to provide systems for holding fragile items which includes a mounting and packaging system which is time efficient, cost effective, and uses ecologically minded materials.

In accordance with one form of the present invention, a system for holding at least one fragile item, such as a piece of artwork and/or a historical object, includes a support panel and at least one fastening device. The support panel is dimensionally suitable for receiving the fragile item and has at least one opening (but preferably, a plurality of openings) formed therein. The support panel may be formed from a metallic composition, such as aluminum or a plastic composition, such as polypropylene. Such material advantageously exhibits substantially no off-gasing. Off-gasing is known to be detrimental to fragile items such as artwork.

The fastening device serves to selectively secure the fragile item to the support panel and includes a fastener member, a fastener securing member and an item-attachment member. The fastener member has first and second end portions whereby the first end portion is formed to pass through the openings in the support panel. The fastener securing member is formed to engage the first end portion so that the fastener member is retained in the support panel (preferably, loosely retained in the support panel after passing through the opening in the panel). The item-attachment member is fixed to the fragile item and has an opening formed therein which permits the second end portion of the fastener member to pass therethrough when aligned therewith and prevents the second end portion from passing therethrough when not aligned therewith. The fragile item is selectively secured to the support panel by aligning the second end portion of the fastener member with the opening in the item-attachment member so that the second end portion passes through the opening. Upon rotation of the second end portion, the second end portion is not aligned with the opening thereby retaining the second end portion in the item-attachment member. In this manner, the fragile item may be shipped or stored on the support panel. Preferably, in accordance with the present invention, a plurality of fragile items may be selectively secured to a single support panel.

Further, the second end portion of the fastener member is preferably substantially T-shaped and, still further, the item-attachment member preferably includes a first pair of projections formed adjacent to the opening and spaced apart a distance substantially equivalent to a width of the T-shaped second end portion. In this way, after the aligned T-shaped second end portion is passed through the opening and then rotated so as not to be aligned therewith, the T-shaped second end portion is positioned between the pair of projections such that the T-shaped second end portion is prevented from aligning with the opening in the item-attachment member. Preferably, a second pair of projections is provided on the item-attachment member which are also adjacent the opening but opposite the first pair of projections. The second pair of projections is spaced with respect to one another in a similar manner to the spacing of the first pair of projections. Thus, when the T-shaped second end portion is rotated out of alignment with the opening in the item-attachment member, both pairs of projections prevent the second end portion from returning to alignment.

Also, the item-attachment member preferably includes a first member pivotally coupled to a second member whereby the first member contains the opening for receiving the fastener member and the second member is fixed to the fragile item.

In another embodiment of the present invention, the system may further include a support frame whereby at least one support panel is mounted therein. A cushioning member, such as a silicone extrusion layer, or other type of shock absorbing material, may be provided on at least a portion of a periphery of the support panel (but preferably around the entire periphery). The silicone extrusion layer provides for vibration dampening between the support panel containing the fragile items and the support frame. A substantially transparent panel (e.g., a plexiglass panel) may preferably be fitted over either side of the support frame so that the fragile item or items secured therein may be viewed without removing them from their protective environment.

In yet another embodiment of the present invention, the system may further include a container with aligned slots in opposing walls for receiving at least one support frame containing the at least one support panel having at least one fragile item selectively secured thereto.

In a preferred form, the container includes walls which are individually formed by two opposing parallel panels having a center layer therebetween. The opposing panels are preferably formed from a metallic composition (e.g., aluminum) or plastic composition (e.g., polypropylene) while the center layer is preferably of honeycomb construction.

The support frame in this embodiment is constructed with a standard "U" aluminum channel. A silicone extrusion is positioned within the U-channel, which in turn supports the aluminum screen.

Still further, the support frame may include opposing first and second walls with each wall having at least one recess (e.g., groove, slot, etc.) formed therein for receiving a rod such that the recess on the first wall substantially aligns with the recess on the second wall. A rod, for supporting at least one fragile item, having two ends may be respectively inserted into the recesses formed in the walls of the support frame. In this manner, a fragile item, such as a tapestry, may be selectively held within the support frame.

In yet a further embodiment of the present invention, the fragile item holding system may be used to selectively retain items which are not substantially flat in nature, e.g., sculptures. In such an embodiment, the system includes a support panel mounted in a support frame, preferably, in such a manner as described above. However, the support frame may further include strap attachment fasteners mounted within mounting holes formed in the support frame. The system may also include at least one strap, but preferably a plurality of straps, attached to the strap attachment fasteners so that the fragile item is held in the support panel for shipping and/or storing. A foam layer may be mounted on the support panel within the support frame having a cut-out which substantially conforms to an outline of the fragile item secured to the support panel. A substantially transparent cover may also be attached to the support frame to allow for viewing of the items, provide a deterrent to theft, and a cover from air-borne pollutants, water, or vermin.

Thus, the present invention provides a unique system for use in transporting, handling and storing artwork and other fragile items, such as historical objects. The present invention permits objects of various sizes and widths to fit within the support frame thereby completely eliminating the need for custom-made crates or containers. The present invention may be utilized in combination with standard transport containers. The multi-use feature of the present invention allows for objects such as paintings, both framed or unframed, matted or framed works on paper, tapestries and various odd-shaped objects including sculptures, reliefs, or ethnographic and historical objects to be transported, handled and stored.

Furthermore, the system of the present invention permits museums, galleries, historical organizations, and traveling exhibitions to utilize the same support frame for handling, transporting and storing art objects. The reusability feature of the present invention eliminates the high cost of recrating each individual object each time the object is to be transported. The system is versatile in that both substantially flat pieces of artwork, e.g., paintings and tapestries, as well as non-flat objects, such as sculptures, may be shipped, handled and/or stored using the same support panel and support frame combination. The interchangeability and multiple use of the system in accordance with the present invention allows for efficient and cost effective packing and crating of all object types, permitting the system to be used for last minute or emergency shipments with the least waste of time and materials. Based on the unique fastening devices used in accordance with the present invention, packing and crating time is substantially reduced which, in turn, reduces cost and personnel required for packing. The system components are preferably chosen to exhibit no off-gasing and are substantially 100% inert. There is also no loose mounting hardware which can accidentally damage the fragile items to be secured thereby. Still further, the fragile items may be secured within the system with a plexiglass cover which provides protection from ultraviolet light, water and dust, while permitting for viewing of the fragile items contained therein.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
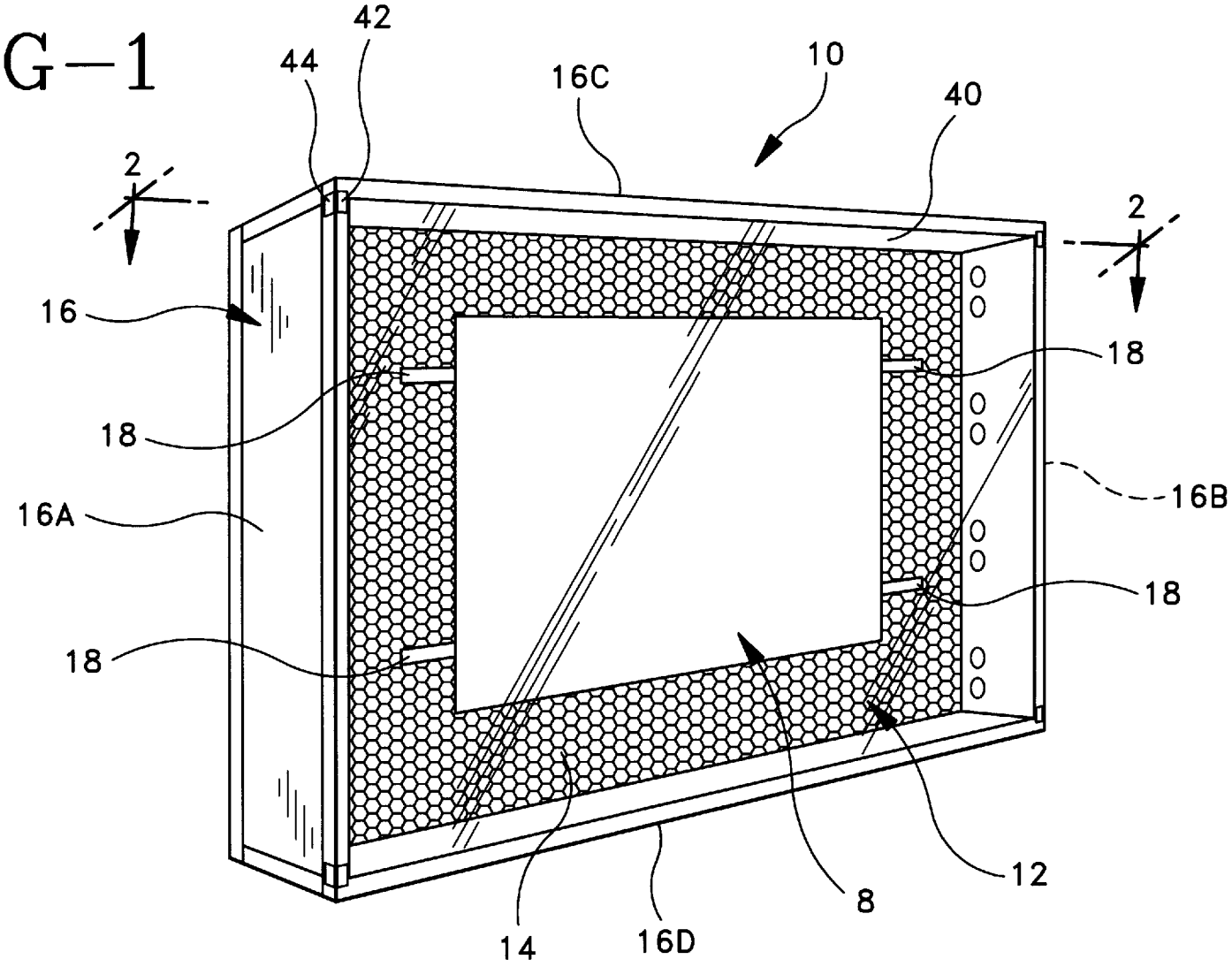
FIG. 1 is a front perspective view of a fragile item holding system of the present invention.

Referring initially to FIG. 1, a preferred form of a system 10 for shipping, handling and/or storing at least one fragile item 8, e.g., a piece of artwork or an historical object, is shown. The system 10 basically includes a support panel 12 upon which a fragile item 8 is selectively secured via fastening devices 18. The system 10 further includes a support frame 16 in which the support panel 12 is mounted.

The support panel 12 is preferably in the form of an aluminum screen having a plurality of mounting holes (openings) 14 formed therein. The screen 12 may also be formed from other metallic compositions besides aluminum. One significant feature of forming a support panel having a metallic composition is that such a composition exhibits substantially no offgasing, i.e., is substantially 100% inert. It is known that materials such as wood, which is used in some conventional artwork packaging systems, releases gases which are detrimental to artwork located in the proximity of the wood. Thus, using an aluminum screen, as in the present invention, substantially eliminates such a harmful effect. The aluminum used to form the support panel may preferably be of the type standardly designated as 14 B&S GA. 303-H14. The preferred general shape of the aluminum screen is rectangular and may be formed in a variety of sizes depending on the sizes of the items to be selectively secured thereon. The thickness of the aluminum screen 12 is chosen such that the screen 12 exhibits sufficient rigidity to support the items secured thereon, while also being sufficiently lightweight to reduce the overall shipping weight associated with the system. The mounting holes 14 on the screen 12 are preferably of sufficient size to accommodate the fastening devices 18 in a manner which will be described in detail later. Each hole 14 may preferably have a diameter of approximately ¼ of an inch, with each hole being centered ⅜ of an inch from the center of each adjacent hole.

Figure 2:
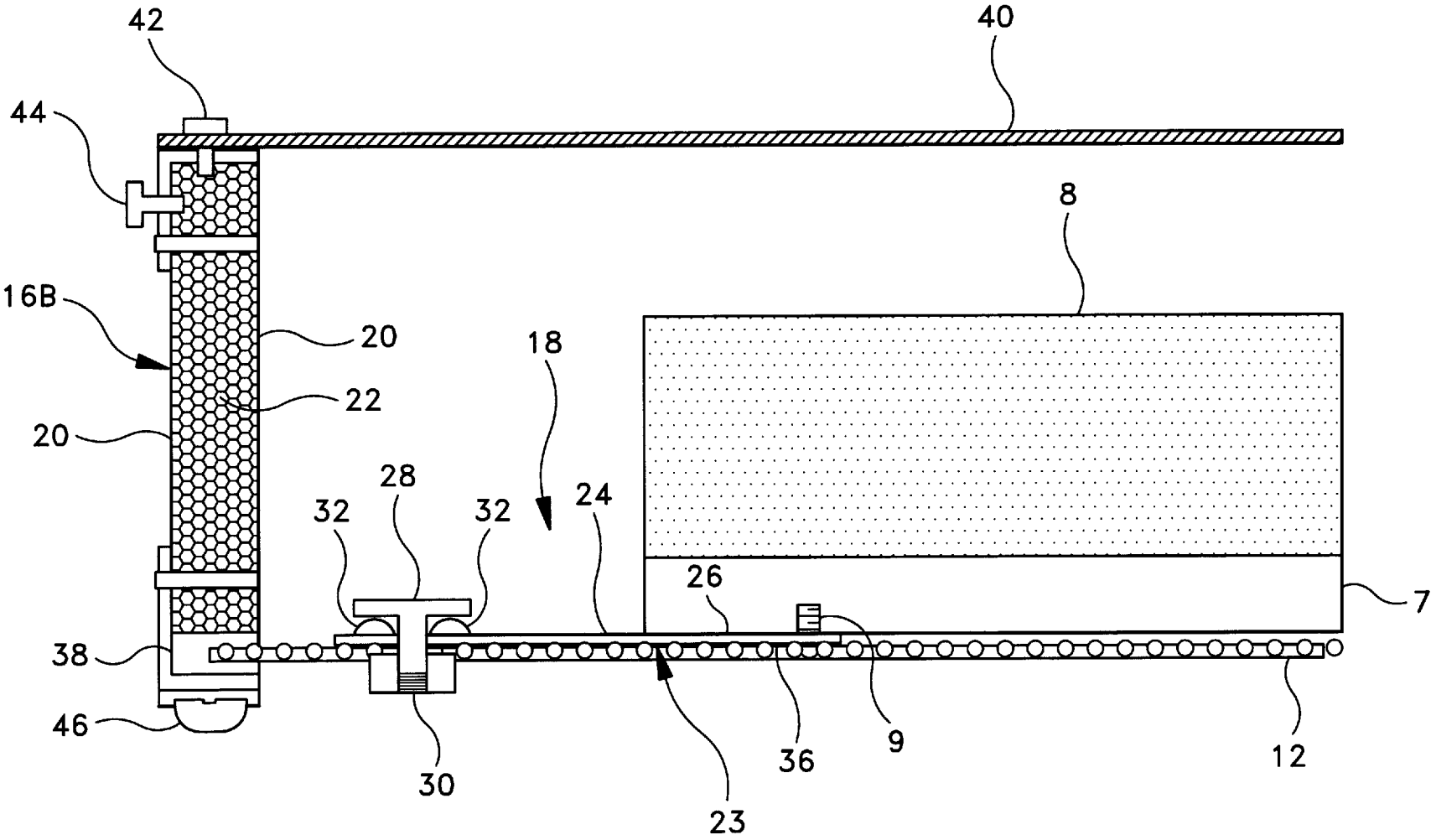
FIG. 2 is a partial cross sectional plan view of a system of the present invention taken along line 2—2 of FIG. 1.

The support frame 16 is preferably formed in a generally rectangular shape by walls 16A through 16D, as shown in FIG. 1. As best shown in FIG. 2, each wall 16A through 16D is formed by a pair of aluminum panels 20 with a honeycomb center layer 22 sandwiched therebetween. The pair of aluminum panels 20 are lightweight and highly corrosion resistant and may preferably be formed from aluminum of the type standardly designated as 0.032-3105 anodized aluminum. The honeycomb/aluminum panel combination provides substantial protection to the fragile items held therein against damaging forces. Particularly, due to the honeycomb center layer 22, which has a significantly high weight resistance ratio associated therewith, large sized support frames may be constructed to transport and/or store objects of substantial weight.

Further, as shown in FIG. 2, the aluminum screen 12 is isolated from direct contact with the support frame 16 by a cushioning layer 38. The cushioning layer 38 is preferably in the form of a silicone extrusion layer which advantageously provides vibration dampening between the screen 12 and the support frame 16. The silicone extrusion preferably extends along the entire periphery of the screen 12 so that no portion of the screen 12 directly contacts walls 16A through 16D. Such vibration dampening serves to substantially protect the fragile items from the potentially detrimental forces and movements involved with the handling of the system.

The support frame 16 may also include an optional transparent panel, e.g., plexi-glass cover (FIGS. 1 and 2), which is held to the frame by fasteners 42. Also, hanging supports 46 in the shape of D-ring hangers may be positioned on the back side of the support frame 16 (FIG. 2) so that the support frame 16 may be hung on a wall with corresponding wall anchors. In this manner, the present invention enables the system 10 to not only be used for shipping and storing artwork, but also enables the system to be used for displaying/exhibiting such artwork in the protective environment of the support frame 16.

Figure 3:
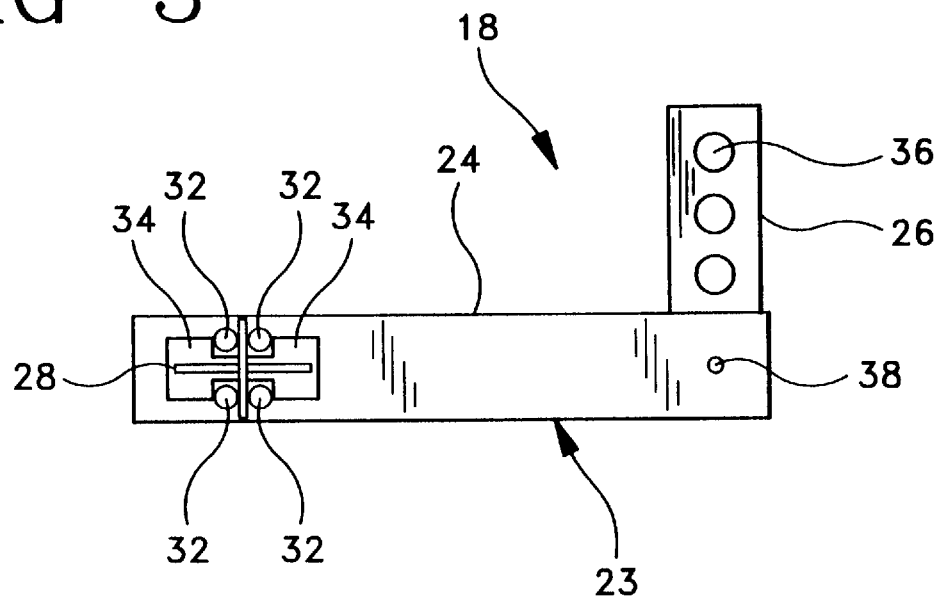
FIG. 3 is a top plan view of a fastening device of the present invention.

The fragile item 8 is selectively secured to the support panel 12 via fastening devices 18. Depending on the size and shape of the item 8, one or more fastening devices may be employed. As shown in FIGS. 2 and 3, each fastening device 18 includes an elbow anchor bracket 23, a fastener member 28 and a fastener securing member 30.

The elbow anchor bracket 23 (i.e., item-attachment member) includes a first member 24 and a second member 26. FIG. 2 shows bracket 23 as having a planar unitary body with members 24 and 26 being in the same plane. However, in a preferred embodiment, the first member 24 is pivotally coupled to the second member 26 by a pivot pin 38, as shown in FIGS. 3 and 4A through 4D. Due to the preferred pivoted coupling between members of bracket 23, the first and second members 24 and 26 reside in separate but parallel planes (FIGS. 3 and 4A through 4D). The second member 26 includes a plurality of mounting holes which are sized to accommodate a mounting screw 9 (FIG. 2). The second member 26 of the bracket 23 is directly affixed to the fragile item 8 by screw 9 through one of the holes 36. In the situation where a painting canvas is the fragile item being selectively secured to the support panel 12, the screw 9 is inserted through one of the holes 36 and fixed directly to a canvas stretcher 7 which supports the painting canvas, as shown in FIG. 7.

Further, the first member 24 of the bracket 23 has an opening 34 formed therein, as shown in FIGS. 3 and 4A through 4D. The opening 34 is uniquely shaped to preferably form an opened double T-shaped design. The uniquely shaped opening 34 permits a first T-shaped end portion of fastening member 28 to pass therethrough when properly aligned therewith. However, the opening 34 also prevents the same T-shaped end portion from passing therethrough when not aligned therewith. Also, the first member 24 of the bracket 23 preferably has four projections 32 formed thereon. The projections 32 are arranged in opposing pairs located adjacent the opening 34 with the two projections 32 of each pair being spaced apart a width which is substantially equivalent to a width associated with the T-shaped first end portion of the fastener member 28.

To selectively secure item 8 to screen 12, a second end portion of fastener member 28 is passed through one of the mounting holes 14 formed in screen 12. The second end portion of member 28 is preferably partially threaded such that the fastener securing member 30, which is preferably correspondingly threaded, may engage the second end portion of member 28.

Figure 5B:
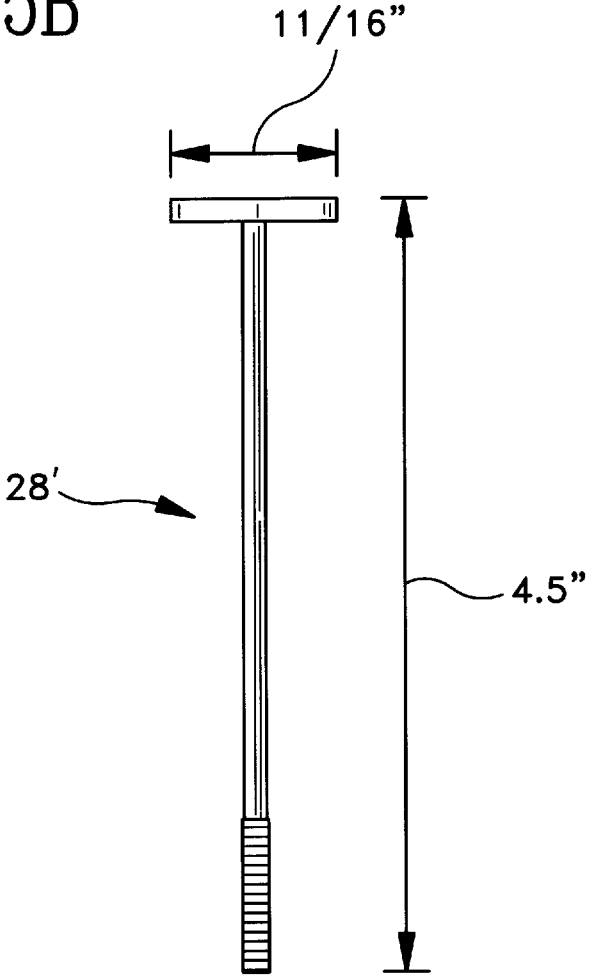
FIGS. 5A through 5D are front elevation views of certain examples of components of a fastening device of the present invention.
Figure 5A:
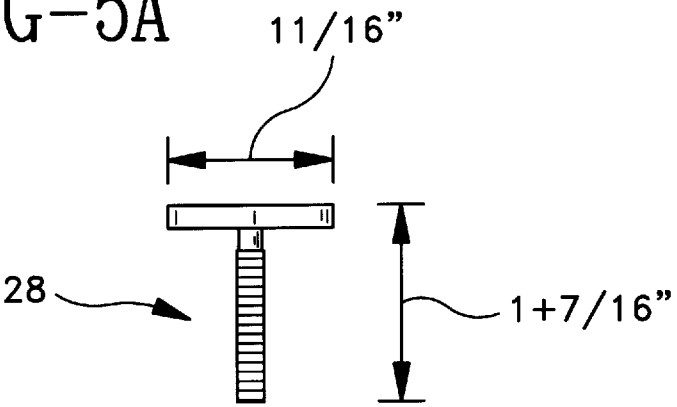
Figure 5D:
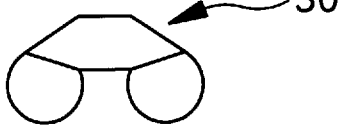
Figure 5C:
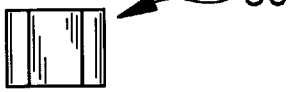

FIGS. 5A and 5B show exemplary embodiments of a fastener member 28 of the present invention, particularly, T-bolt 28 and T-bolt 28'. While dimensions are shown by way of example in FIGS. 5A and 5B, it is to be appreciated that the dimensions are not necessarily critical; rather, it is the shape of the fastener member 28 with respect to the opening 34 in bracket 23 that is one of the key features of the present invention. FIGS. 5C and 5D show examples of fastener securing members 30. Preferably, either a standard butterfly nut 30' or a custom nut 30 may be employed.

Figure 4A:
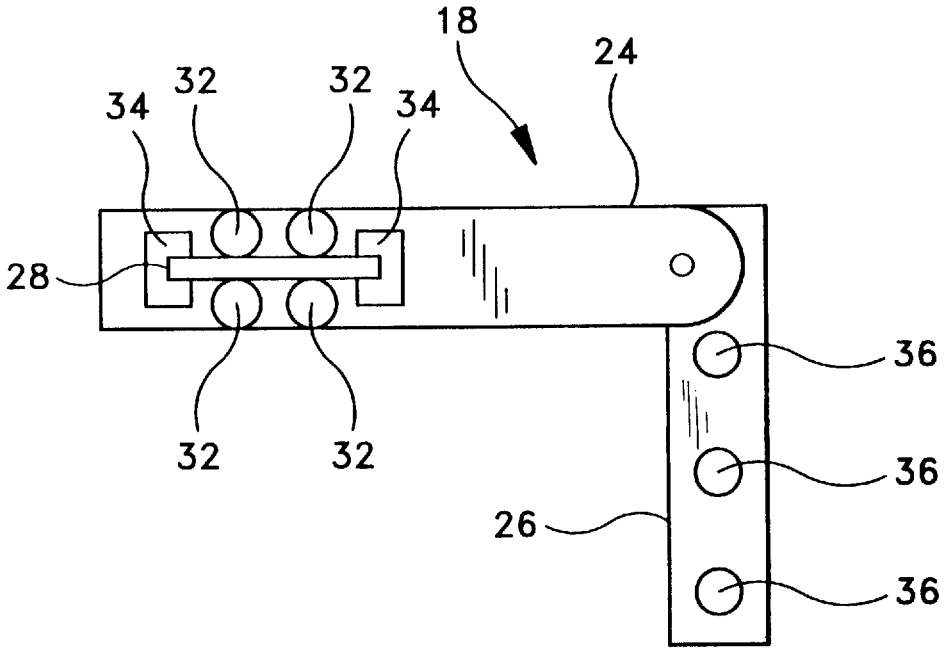
FIGS. 4A through 4D are respective top plan views of a fastening device of the present invention illustrating the unique locking action associated therewith.
Figure 4B:
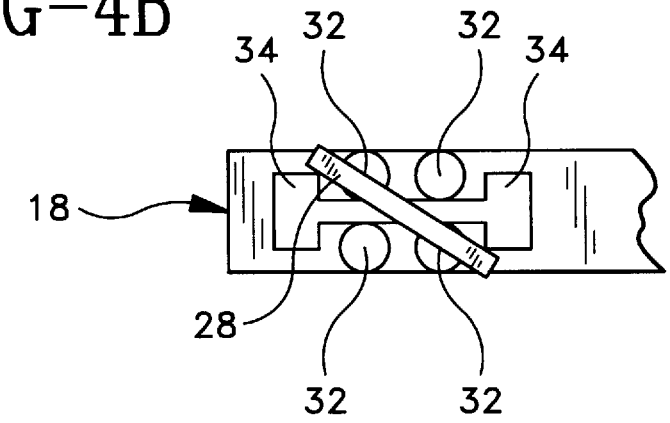
Figure 4C:
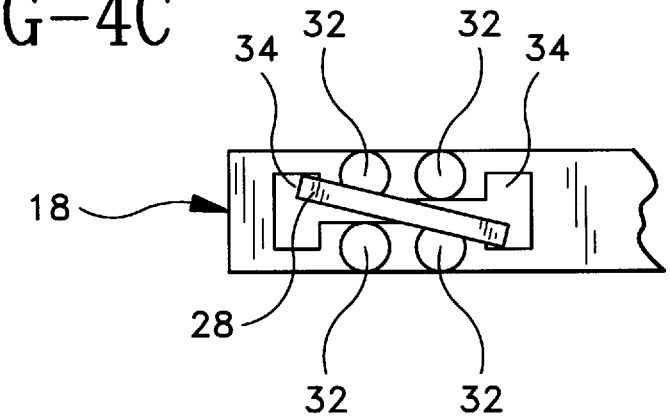
Figure 4D:
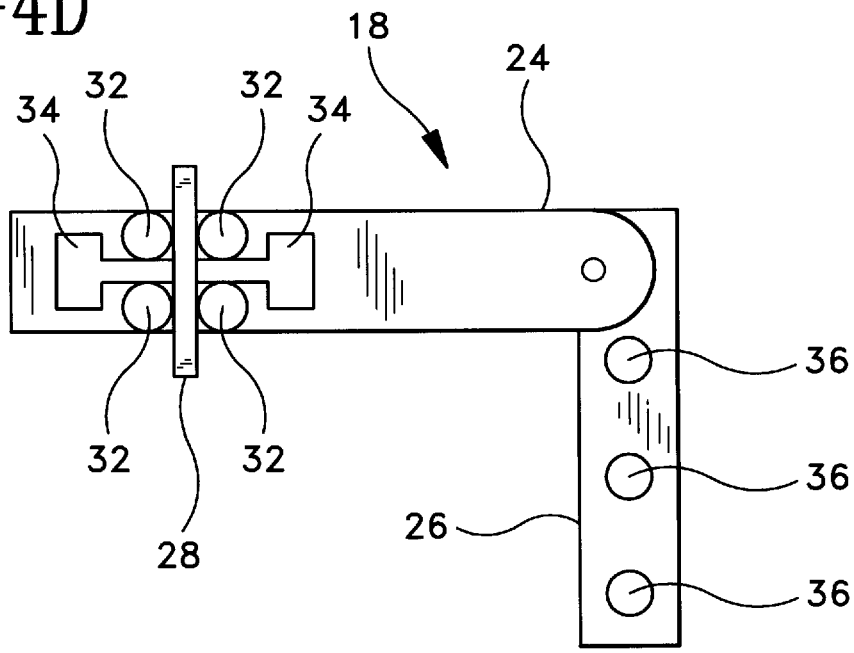

Initially, it is preferred that the nut 30 be loosely threaded onto the threaded portion of T-bolt 28 so that the T-bolt 28 is retained in the screen 12, but can be rotated within the mounting hole 14 of the screen 12 through which it passes. Next, the second end portion of the T-bolt 28 is rotated so as to align with the opening 34 of the elbow anchor bracket 23 which is attached to the item 8. The second end portion is then passed through opening 34 of bracket 23, as shown in FIG. 4A. Then, as shown in FIGS. 4B and 4C, the T-bolt 28 is rotated (in either direction) so that the second end portion is no longer aligned with the opening 34 and rests between each pair of projections 32, as shown in FIG. 4D. The fastener securing member 30 is then tightened on the first end portion of the T-bolt 28 so that the T-bolt may no longer be rotated into alignment with the opening 34. As previously mentioned, one or more fastening devices 18 of the present invention may be employed, in the manner described above, to selectively secure the fragile item 8 to the support panel 12.

Figure 6:
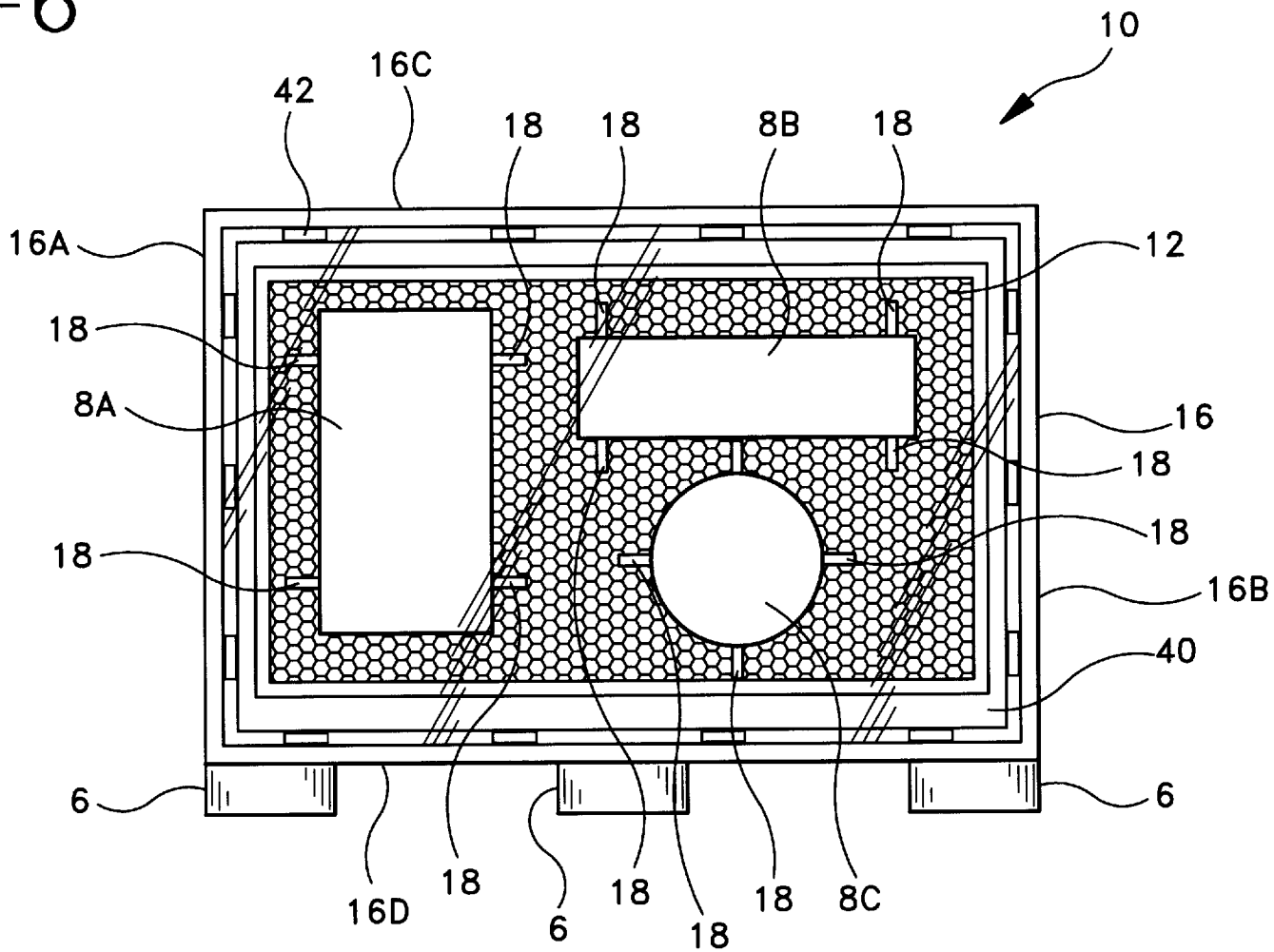
FIG. 6 is a front elevation view of a system of the present invention selectively securing a plurality of fragile items therein.

Furthermore, more than one fragile item may be selectively secured on the aluminum screen 12 by one or more fastening devices 18. By way of example, as shown in FIG. 6, each fragile item 8A, 8B and 8C is selectively secured to screen 12 via four fastening devices 18. Another feature shown in FIG. 6 is that wooden palette supports 6 may be attached to wall 16D of the support frame 16 so that the entire system 10 may be loaded or unloaded by a forklift, or the like, at a particular location.

Figure 7A:
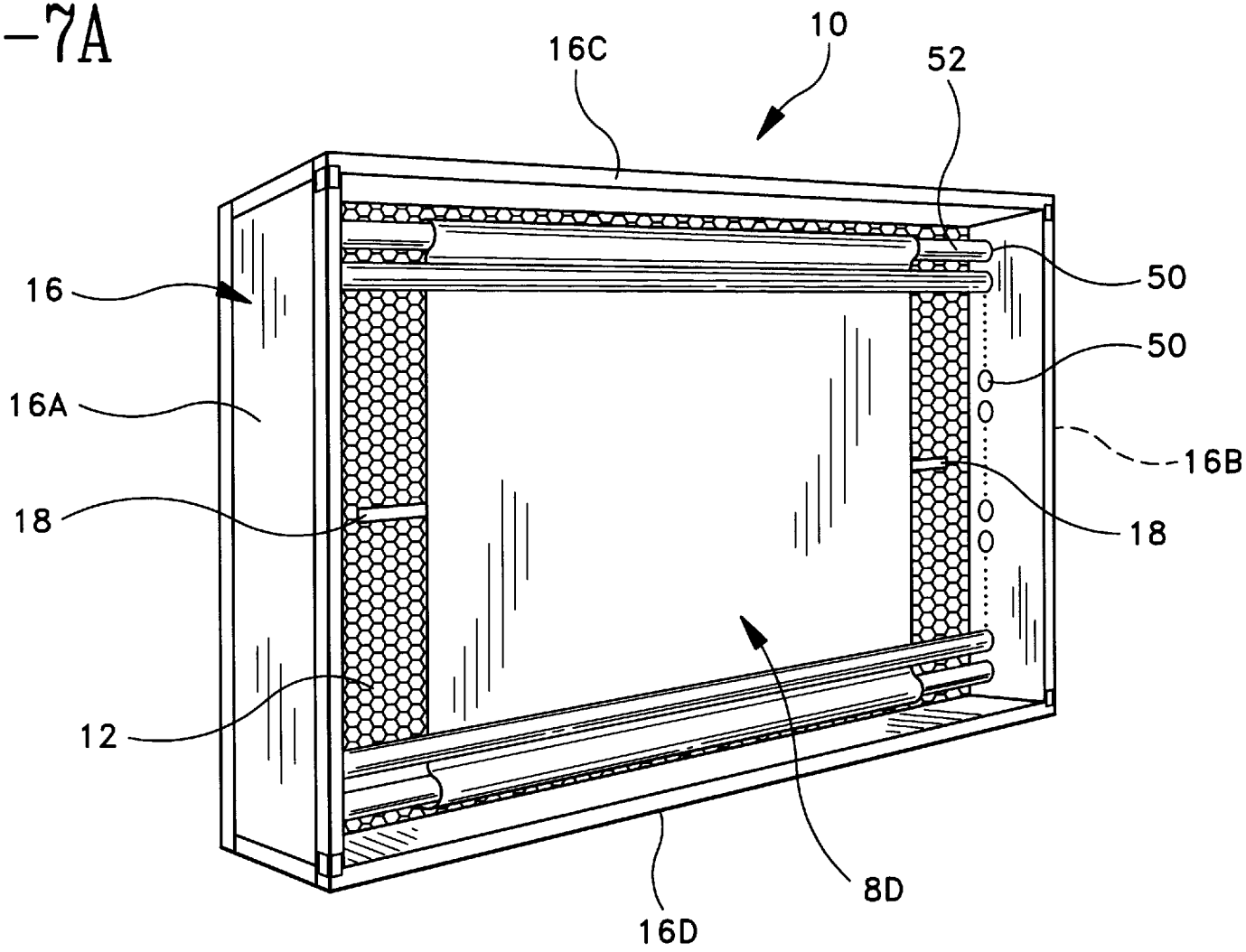
FIGS. 7A and 7B are front perspective and elevation views, respectively, of a further embodiment of a fragile item holding system of the present invention.
Figure 7B:
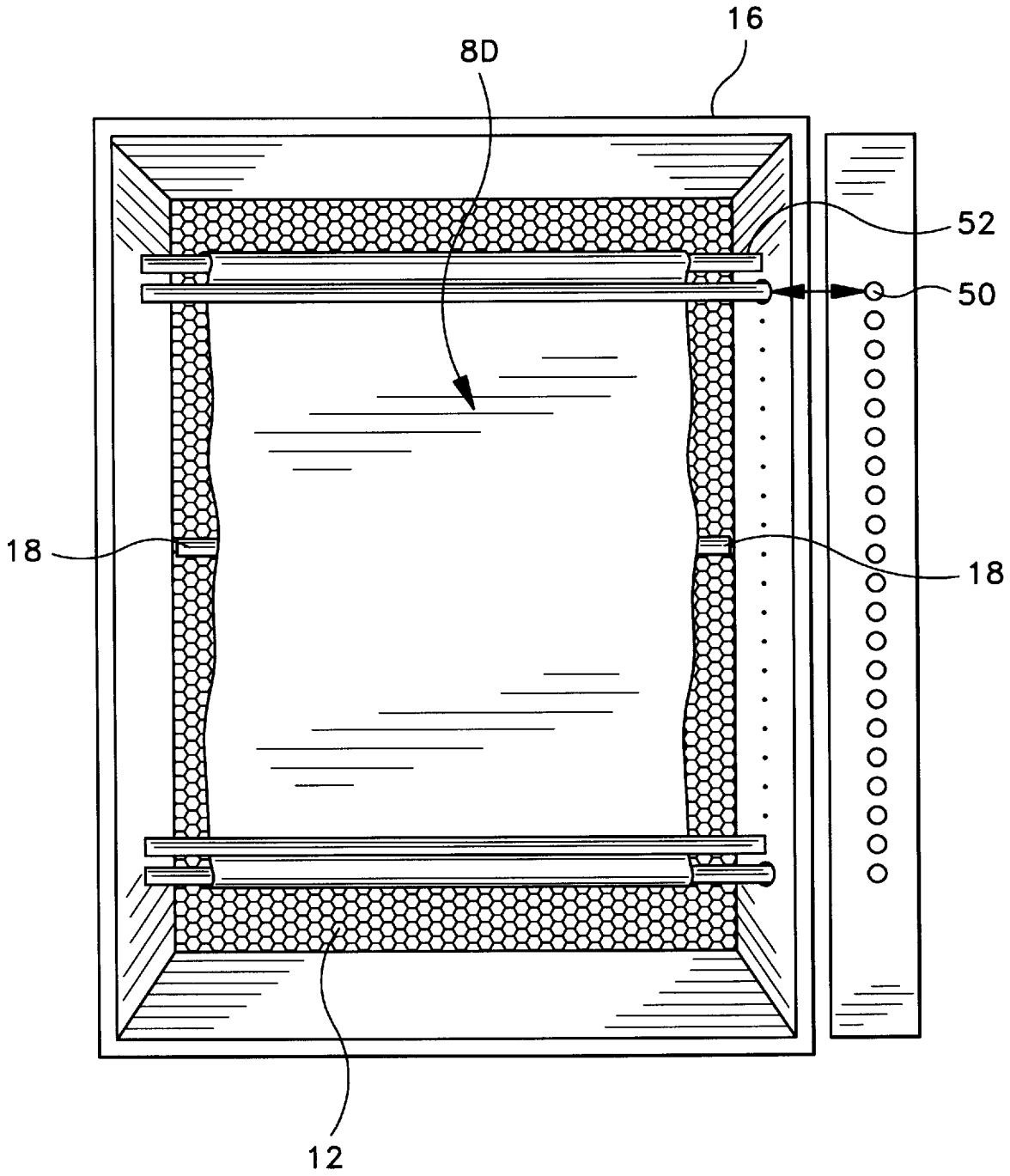

In a further embodiment of the present invention, as shown in FIGS. 7A and 7B opposing walls 16A and 16B of support frame 16 may further include a plurality of recesses 50 formed therein. Each recess 50 is formed to receive one end of a rod 52. The rod 52 is preferably formed from a metallic composition, such as aluminum, substantially to eliminate off-gasing. The rod 52 may have a spring retention member on at least one end so that the spring retention member compresses when inserted into one recess 50 in order that the other end may be placed in the corresponding recess 50 on the opposing wall. The rod 50 may alternatively be formed to have at least two telescoping members whereby the rod is kept in a retracted state when being aligned between opposing recesses 50 and then spread apart to engage the recesses. Still further, opposing recesses 50 may be formed to be substantially U-shaped so that each end of the rod 52 slides into the open side of the U-shaped recess. Other engagement means will be appreciated by one skilled in the art.

Such an embodiment as shown in FIGS. 7A and 7B is advantageously used to transport, handle and/or store tapestries and the like. Specifically, the rods 52 permit a tapestry 8D to be securely attached at two ends, as shown in FIG. 7A. One rod 52 may be passed through one looped end of the tapestry 8D with another rod 52, which does not pass through the tapestry 8D, positioned parallel and in close proximity to the first rod. A similar combination of two rods may be employed at the other end of the tapestry 8D. In addition, one or more fastening devices 18 may be positioned at certain points between the ends of the tapestry 8D held by the rods 52. Positioning the fastening devices 18 in such a manner substantially prevents the tapestry 8D from moving or billowing. Again, to further protect the tapestry 8D, a transparent panel (e.g., panel 40) may be mounted on support frame 16.

It is also to be understood that since the aluminum screen 12 is perforated with a plurality of mounting holes 14, an additional cover panel (not shown) may be placed on the rear side of the support frame 16 (opposite to the transparent cover). In this manner, the support frame is substantially sealed such that the area inside the frame 16 is protected from forces and elements, e.g., dust and water, which are detrimental to the fragile item or items contained therein.

Figure 8:
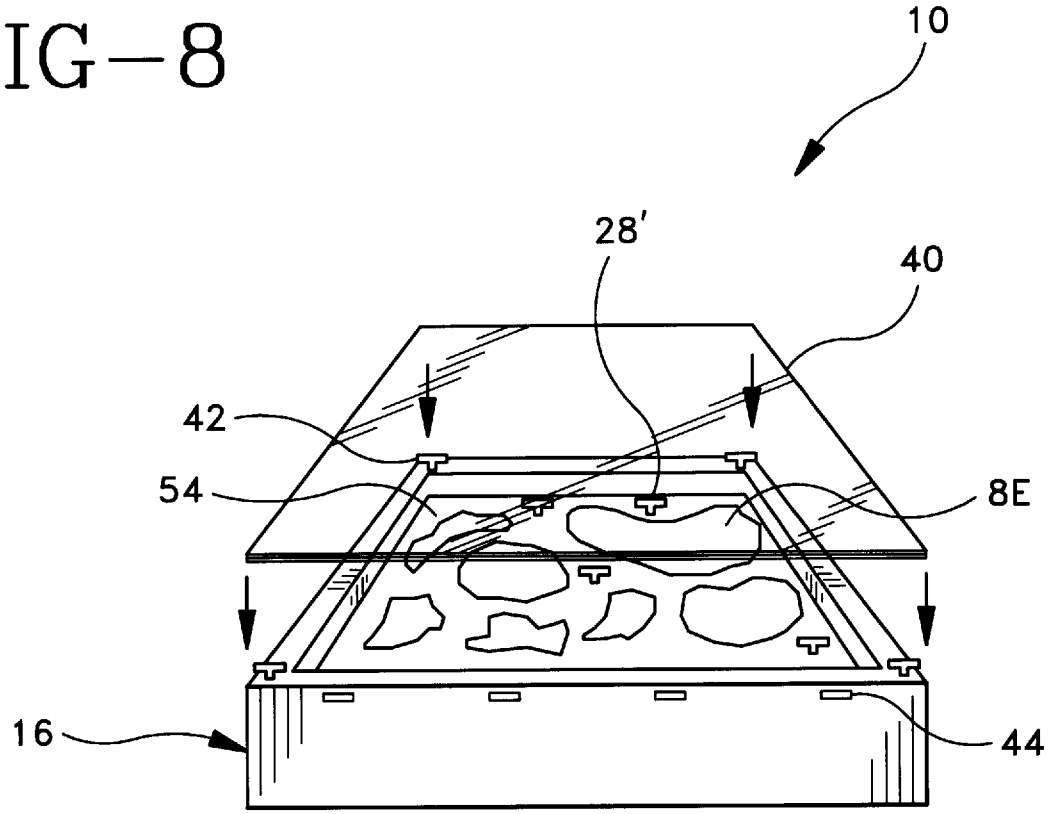
FIG. 8 is a top perspective view of yet another embodiment of a fragile item holding system of the present invention.

Referring now to FIGS. 8–11, a further embodiment of the system 10 of the present invention is shown. Such embodiment further illustrates the broad versatility of the present invention, such versatility being unknown in the prior art. Specifically, the support frame 16 may be turned to rest on its back side (e.g., 90°), as shown in FIG. 8. Thus, fragile items 8E (which are not necessarily substantially flat, as opposed to items 8A through 8D) may be selectively secured therein, in accordance with the present invention.

The items 8E may be selectively secured to the screen 12 in the same manner as previously described. In addition, a foam layer 54 may be positioned on the screen 12 and held in place by fastener members 28' (FIG. 5B). The fastener member 28' preferably passes through the foam layer 52, then through one of the mounting holes 14 in screen 12 where it is then secured by fastener securing member 30 on the opposite side of screen 12 (see FIG. 11). Cut-outs may be formed in the foam layer 54 to accommodate the items 8E so that they rest substantially lower in the foam layer 54, thus, providing more protection thereto.

A transparent cover 40, similar to that described previously, may be mounted to the support frame 16 by fasteners 42, as shown in FIG. 8. It is to be appreciated that fastener 42 may preferably be the same or similar to fastener member 28 (FIG. 5A) or fastener member 28' (FIG. 5B) whereby the threaded portion of fastener member 28 or 28' is threaded into a correspondingly threaded mounting hole formed in support frame 16.

Figure 9:
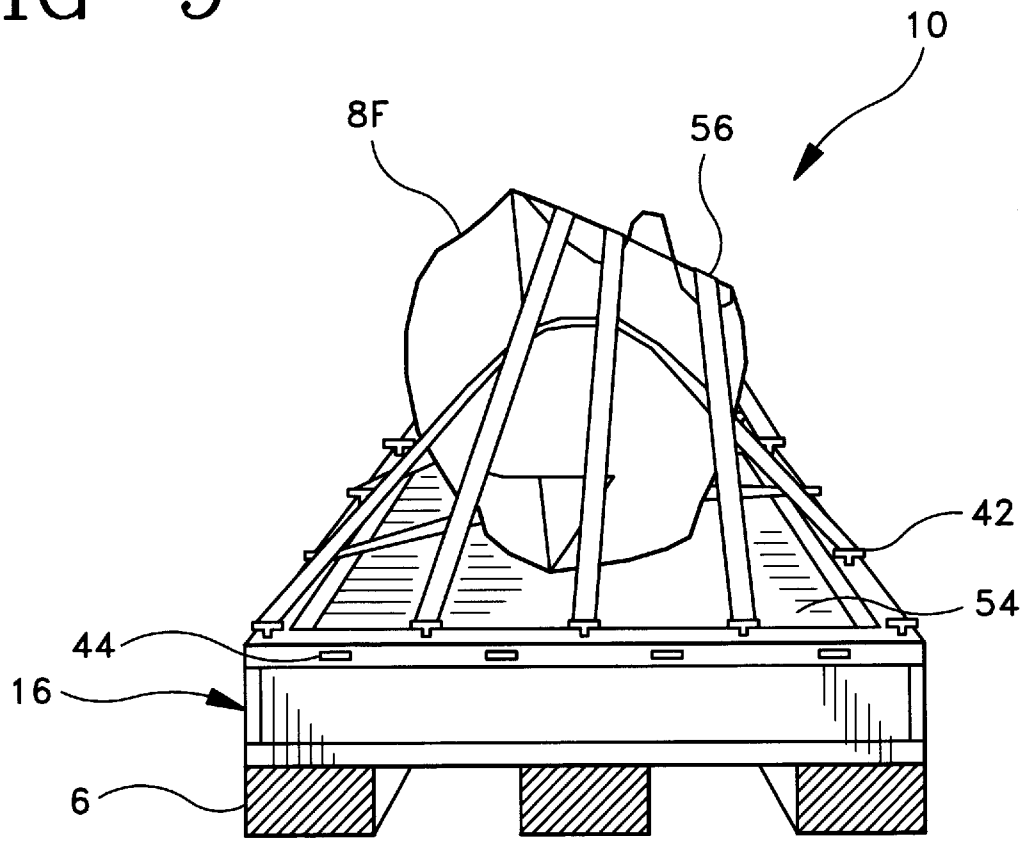
FIG. 9 is a front elevation view of still a further embodiment of a fragile item holding system of the present invention.
Figure 11:
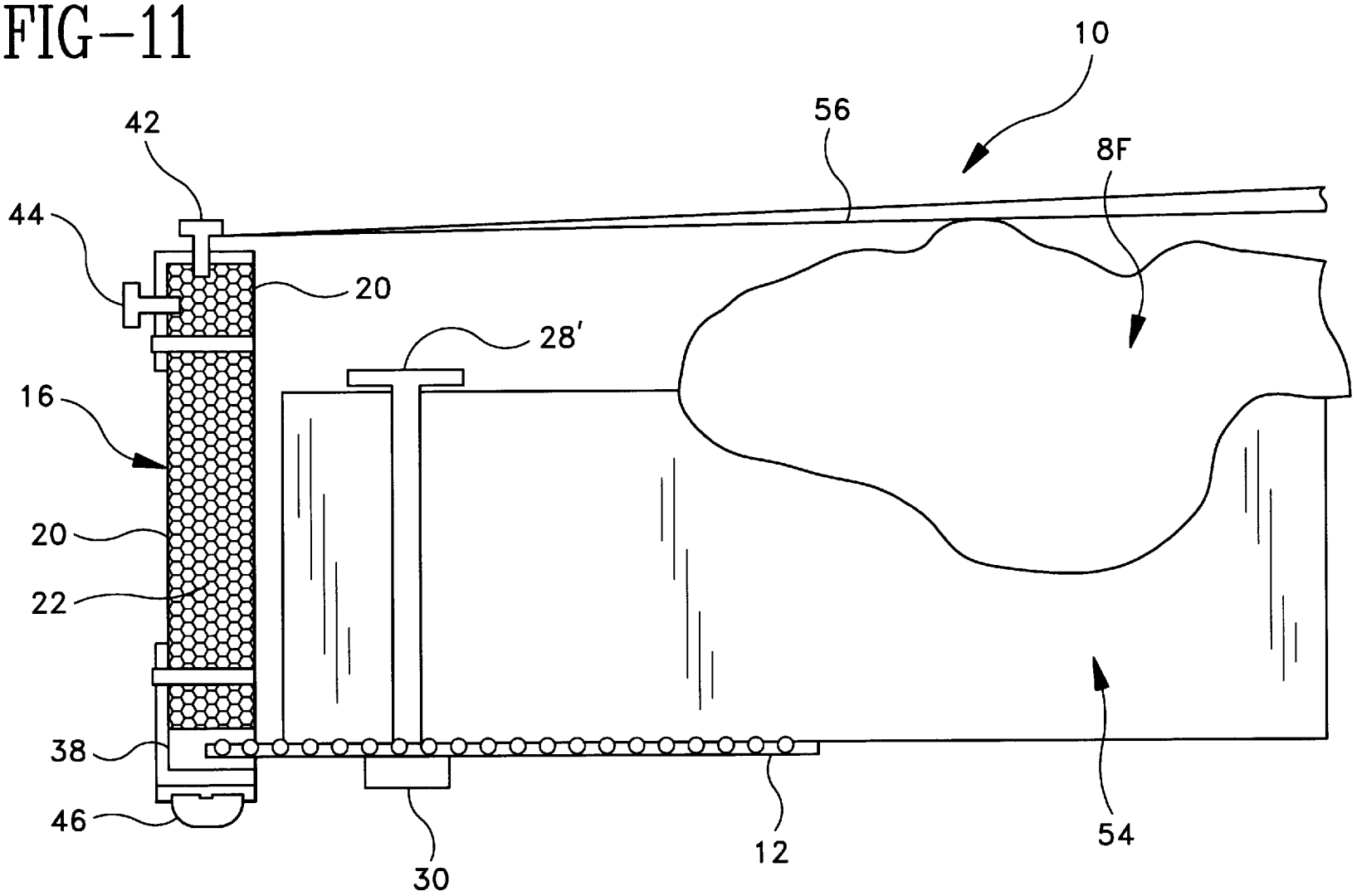
FIG. 11 is a partial cross sectional side view further illustrating features of the system of the present invention shown in FIGS. 8 through 10.

FIG. 9 shows a variation to the embodiment shown in FIG. 8 whereby a larger fragile item 8F may be selectively secured to the support frame 16 using one or more securing straps 56. Securing straps 56 are removably affixed to fasteners 42 (e.g., fastener members 28 or 28') after being positioned over the item 8F. Each strap 56 may have a buckle or ring, on each end, which correspondingly engages the portion of the fastener 42 protruding from support frame 16. Foam layer 54 is positioned below item 8F and above screen 12, not shown, to provide cushioning. If desired, fastener members 28' may be used to fix the foam layer 54 to screen 12, as shown in FIGS. 8 and 11. Also, wooden palette supports 6 may be mounted on the bottom of the frame 16 to facilitate loading and unloading of the system 10 via a forklift or the like.

Figure 10:
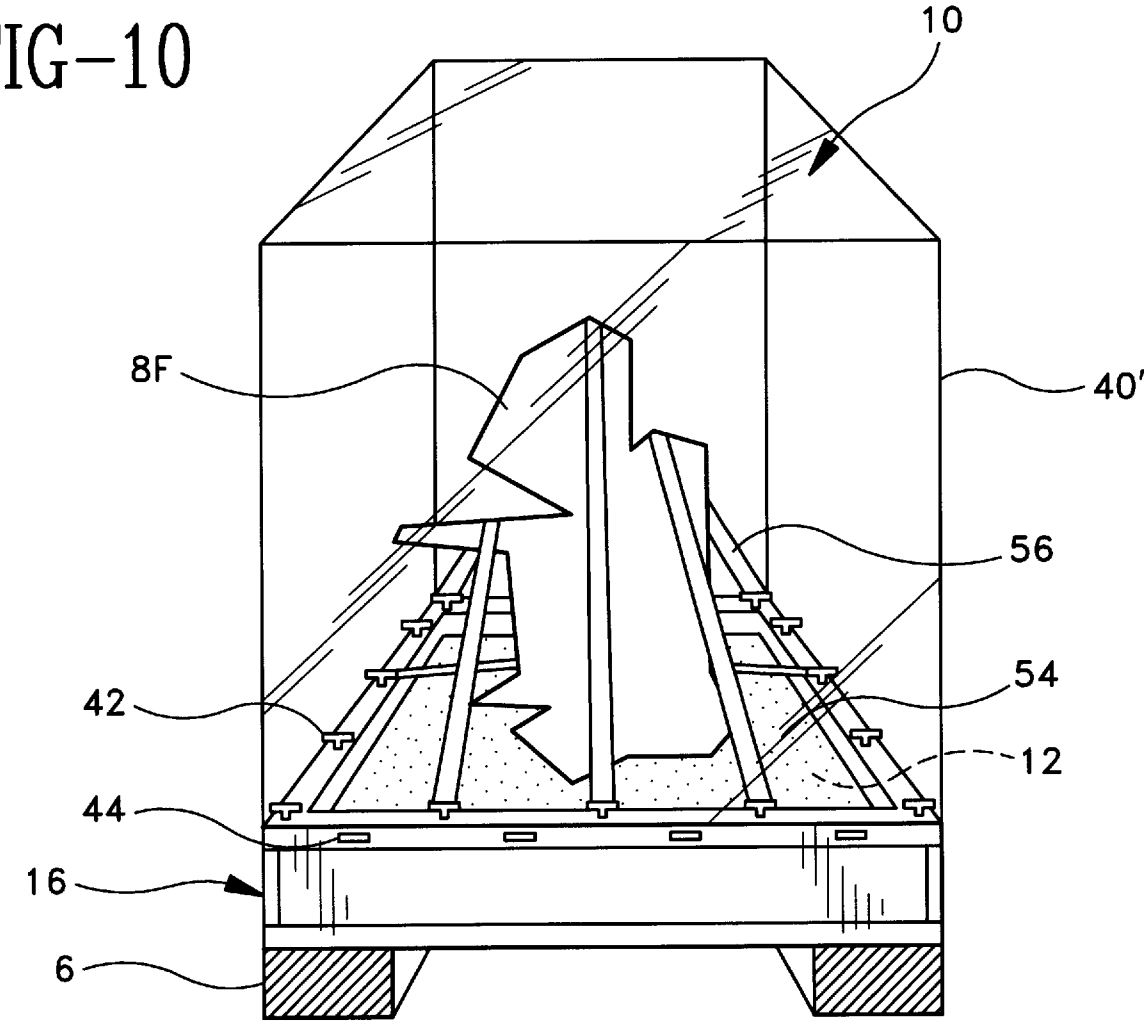
FIG. 10 is a top perspective view of yet another embodiment of a fragile item holding system of the present invention.

FIG. 10 shows a further variation of the embodiment shown in FIG. 9. A raised transparent cover 40' is mounted to support frame 16, via fasteners 44, which provides further environmental protection to item 8F which is selectively secured by system 10. Again, such a feature permits item 8F to be displayed without being removed from the system 10 in which it is also shipped or stored. Similar to fasteners 42, fasteners 44 may also be the same as, or similar to, fastener members 28 or 28' whereby fasteners 44 are threaded into mounting holes on the sides of frame 16, as shown in FIG. 10. In addition, FIG. 11 shows a cross-sectional side elevation view similar to the embodiments shown in FIGS. 9 and 10. Specifically, the fastener member 28' is shown passing through foam layer 54 and screen 12 and secured by fastener securing member 30.

Figure 12A:
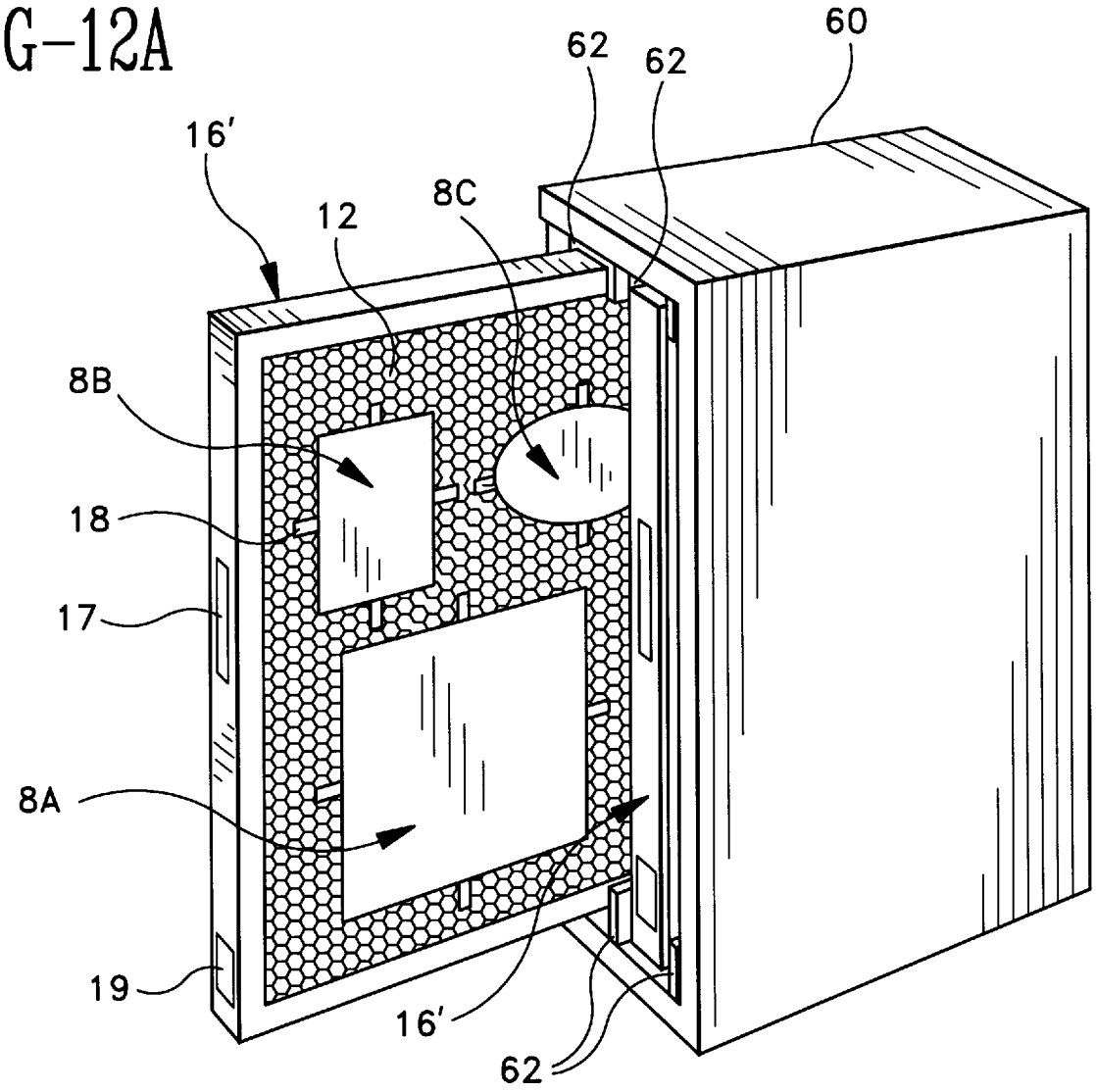
FIGS. 12A through 12E are a front perspective view and various elevation views, respectively, of an embodiment of the present invention for containing more than one support frame.
Figure 12B:
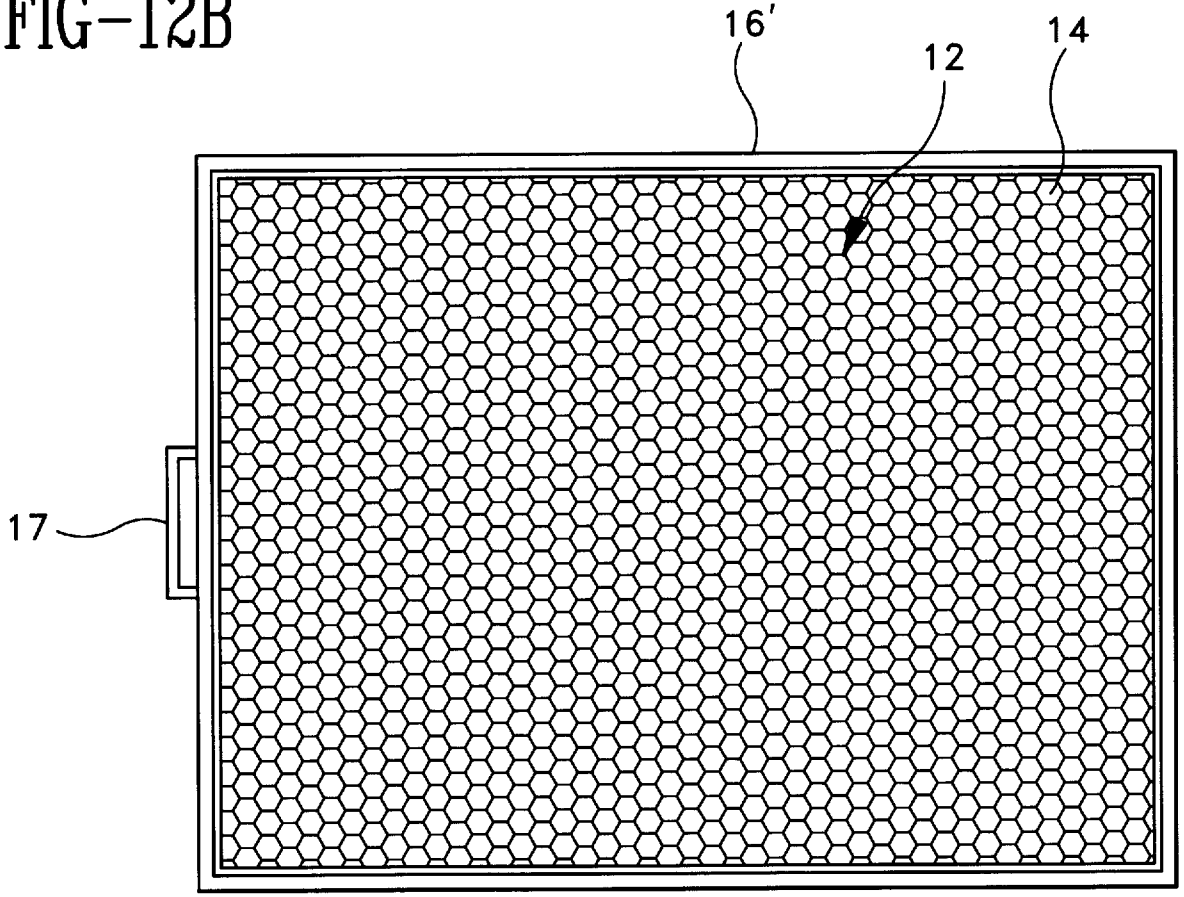
Figure 12C:
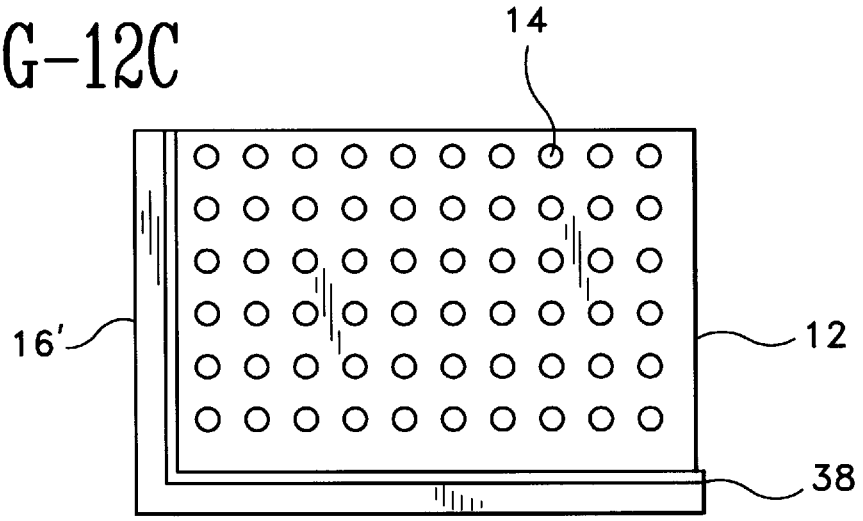

Yet another embodiment of the system 10 of the present invention is shown in FIGS. 12A through 12F. An aluminum screen 12 is mounted in a support frame 16' with fragile items 8A through 8C selectively secured to screen 12 via fastening devices 18. Frame 16' is preferably formed from the same honeycomb/aluminum panel combination, 20 and 22, employed in frame 16. Also, screen 12 and frame 16' are isolated from direct contact with each other by a silicone extrusion layer 38 positioned on the periphery of screen 12 and sandwiched between screen 12 and frame 16' (FIG. 12C). In addition, a shipping container 60 is provided, having walls also preferably formed from the honeycomb/aluminum panel combination, 20 and 22. The walls of the container 60 define a support frame receiving area. Particularly, opposing U-shaped channels 62 are respectively provided on opposing walls of the container 60. The channels 62 are sized to slidably receive a support frame 16' therein. The frame receiving area of the container 60 may preferably include more than one set of opposing channels 62 for receiving multiple support frames 16', e.g., two sets are shown in FIG. 12A for accommodating two support frames 16'. In this manner, the multiple support frames 16' containing fragile items selectively secured thereto may be inserted into container 60 and container 60, itself, shipped or stored.

Figure 12D:
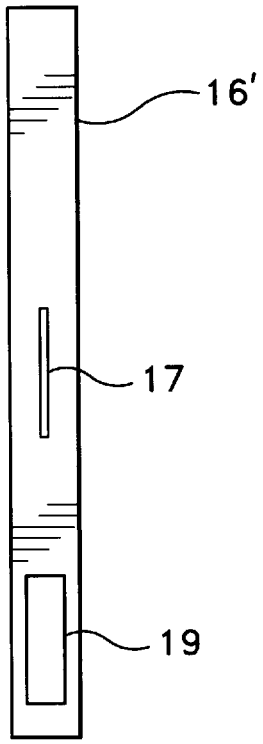
Figure 12E:
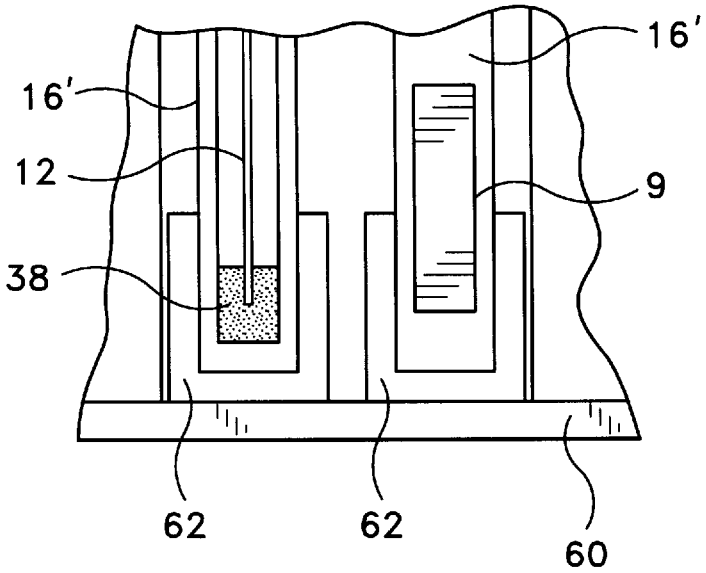

Further, at least one of the walls of the support panel 16' may include a handle 17 and a label 19, as shown in FIGS. 12A and 12D. In this manner, the wall with the handle 17 and label 19 may serve as part of a front wall of the container 60 when the frame 16' is completely recessed into the fragile item receiving area. The handle 17 permits the individual support frame 16' to be extended, on the channels 62, so that the fragile items selectively mounted therein are readily viewable. Although not shown in FIGS. 12A through 12E, the support frame 16' may have a transparent cover (e.g., cover 40) mounted over the fragile items to provide further protection. Also, as previously mentioned, another cover may be mounted behind the screen 12 to protect the items from the rear. The label 19 on the support frame 16' permits each frame 16' and the items selectively mounted therein to be identified in order to facilitate retrieval.

Figure 13:
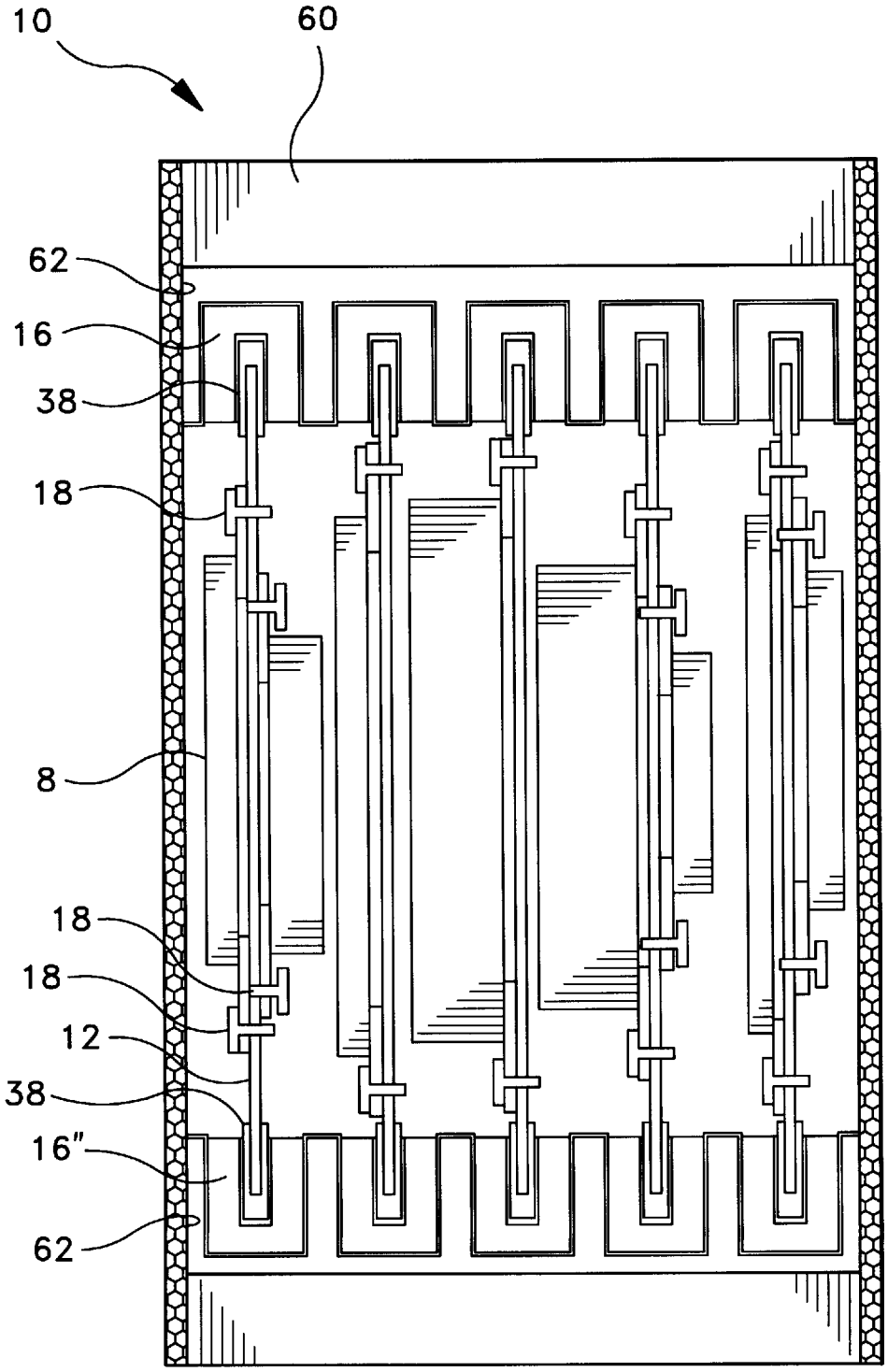
FIG. 13 is a front elevation view of yet another embodiment of the present invention for containing more than one support frame.

Referring now to FIG. 13, a variation of the embodiment shown in FIGS. 12A through 12E is shown. In such embodiment, support frames 16" are shown, each having an aluminum screen 12 centrally mounted therein so that fragile items may be advantageously mounted on either or both sides of screen 12. Again, screen 12 and support frame 16' are isolated by a cushioning layer 38. Similar U-shaped channels 62 are formed in the container so that each support frame 16" may be selectively recessed or retracted therefrom. It is to be appreciated that any of the previously discussed embodiments of the support frame of the present invention may be formed to have the screen 12 positioned centrally therein in order to accommodate fragile items on either or both sides of the screen 12.

Figure 14:
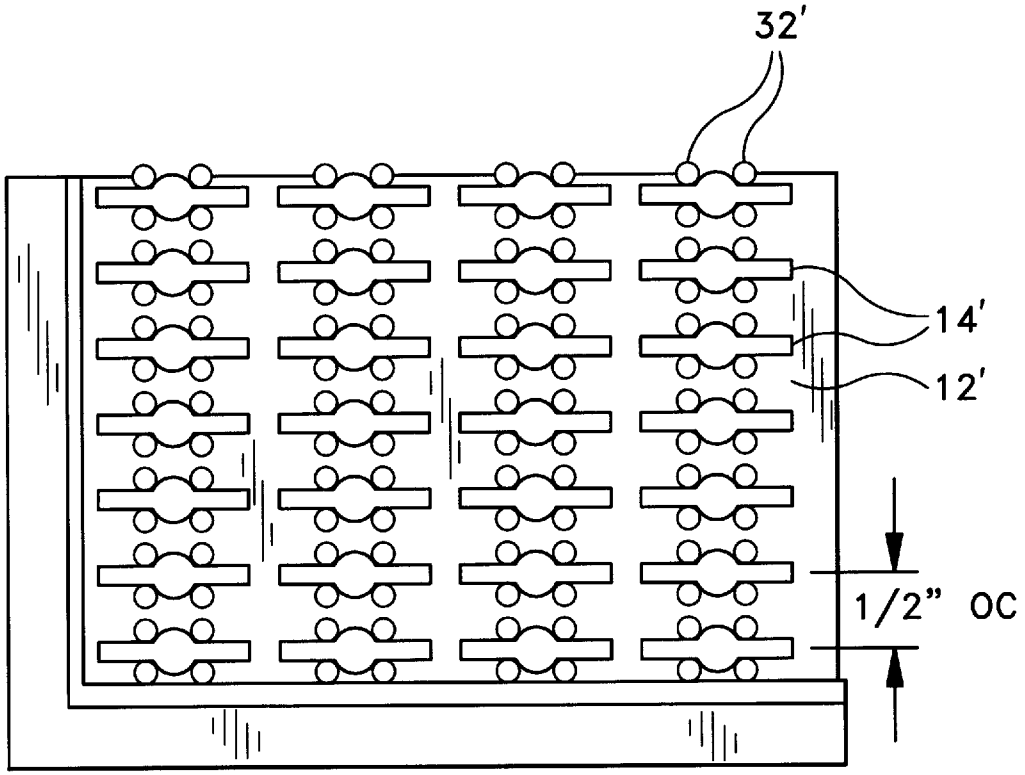
FIG. 14 is an enlarged front/rear elevation view of an alternative form of the screen formed in accordance with the present invention.

Referring to FIG. 14, an alternative form of the screen portion of the system of the present invention is illustrated. More specifically, the screen 12' includes a plurality of elongate holes 14' symmetrically formed over the face of the screen. The screen 12' is preferably made from aluminum or plastic such that the elongate mounting holes 14' can accommodate the use of a T-bolt as earlier described. The screen 12' may further include a series of reliefs 32' surrounding the elongate mounting holes 14' to enhance securement of the bolt thereto. Accordingly, the T-bolt may be permanently attached directly from the back frame of an article to the screen 12' thereby eliminating the use of bolts or other fastening devices as earlier described. Alternatively, the screen 12' may be used with the T-bolt and nut as previously described for holding both substantially flat and three-dimensional objects. The T bolt can be twist-locked into position on the screen to securely hold an object thereto.

Thus, the present invention provides a system for transporting, handling and/or storing fragile items having a wide variety of shapes, sizes and weights. Due to the versatility of the present invention, a single system formed in accordance therewith may be shared by multiple exhibition sites, allowing for further reduction of crating and shipping costs. The system also significantly reduces packing and crating time, thus, lowering the cost and personnel required in performing such tasks. For instance, positioning of the fastening devices 18 on the fragile item and the screen 12 may initially take as little as a few minutes. However, after the initial set up of the elbow anchor bracket 23 in the corresponding T-bolt 28 on the aluminum screen 12, the time allowance is even further reduced. An average artwork exhibition being crated via the system of the present invention can advantageously save as much as 30% over the time required to crate such an exhibition with conventional packaging systems. Because there is no need to substantially modify or restructure the system, no particular experience or training is required to utilize the system.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A system for holding at least one fragile item comprising:

a support panel, the support panel being dimensionally suitable for receiving the at least one fragile item, the support panel having at least one opening passing therethrough; and at least one fastening device for selectively securing the at least one fragile item to the support panel, the at least one fastening device including:

a fastener member, the fastener member having first and second end portions, the first end portion being formed to pass through the at least one opening in the support panel;

a fastener securing member, the fastener securing member being formed to engage the first end portion of the fastener member so that the fastener member is retained in the support panel after being passed through the at least one opening in the support panel; and an item-attachment member for fixation to the at least one fragile item, the item-attachment member having an opening formed therein permitting the second end portion of the fastener member to pass therethrough when aligned with the opening in the item-attachment member and preventing the second end portion from passing therethrough when not aligned with the opening;

wherein the at least one fragile item is selectively secured to the support panel by aligning the second end portion of the fastener member with the opening in the item-attachment member so that the second end portion passes through the opening and, upon rotating the second end portion, the second end portion is not aligned with the opening thereby retaining the second end portion in the item-attachment member so the at least one fragile item may be shipped or stored on the support panel.

2. The system as defined in claim 1 wherein the support panel includes a plurality of openings and wherein the at least one fragile item is secured to the support panel using at least two fastening devices.

3. The system as defined in claim 1 wherein the item-attachment member has a first member and a second member, the first member having the opening formed therein for receiving the fastener member, the second member being fixed to the at least one fragile item, the first member being pivotally coupled to the second member.

4. The system as defined in claim 1 wherein the second end portion of the fastener member is substantially T-shaped.

5. The system as defined in claim 4 wherein the item-attachment member further includes a first pair of projections extending therefrom, adjacent the opening therein and spaced apart a distance substantially equivalent to a width of the T-shaped second end portion of the fastener member, such that after the aligned T-shaped second end portion is passed through the opening and rotated so as not to be aligned with the opening, the T-shaped second end portion is positioned between the pair of projections such that the T-shaped second end portion is prevented from aligning with the opening in the item-attachment member.

6. The system as defined in claim 5 further including a second pair of projections extending from the item-attachment member, adjacent the opening therein and opposite the first pair of projections, the second pair of projections being spaced apart a width substantially equivalent to the width of the T-shaped second end portion of the fastener member, such that after the aligned T-shaped second end portion is passed through the opening and rotated so as not to be aligned with the opening, the T-shaped second end portion is also positioned between the second pair of projections such that the T-shaped second end portion is prevented from aligning with the opening in the item-attachment member.

7. The system as defined in claim 1 further including a cushioning layer held between the at least one fragile item and the at least one support panel by the at least one fastening device.

8. A system as defined in claim 1 wherein the at least one fragile item is a piece of artwork.

9. A system as defined in claim 1 wherein the support panel is formed from a metallic composition.

10. The system as defined in 1 further comprising a support frame, the support panel being mounted in the support frame.

11. The system as defined in 10 further comprising a cushioning member provided on at least a portion of a periphery of the support panel for providing vibration dampening between the support panel and the support frame.

12. The system as defined in claim 10 further comprising a substantially transparent panel mounted to the support frame to permit viewing of the at least one fragile item.

13. The system as defined in 10 wherein the support frame further includes:

opposing first and second walls, each of the walls having at least one recess formed therein for receiving a rod such that the at least one recess in the first wall substantially aligns with the at least one recess in the second wall; and at least one rod for supporting the at least one fragile item, the at least one rod having opposing ends for respectively engaging the recesses.

14. The system as defined in claim 10 wherein the support frame includes at least one wall formed by two opposing parallel panels having a center layer therebetween.

15. The system as defined in claim 14 wherein the two opposing panels are formed from a metallic composition.

16. The system as defined in claim 14 wherein the center layer is formed from a honeycomb composition.

17. The system as defined in claim 10 further comprising a container, the container being dimensioned to receive at least one support frame therein.

18. The system as defined in claim 17 wherein the container includes opposing first and second walls and opposing third and fourth walls defining a support frame receiving area, each of the first and second walls having at least one slot which is substantially coextensive with the first and second walls, respectively, the at least one slot on the first wall being aligned with the at least one slot on the second wall, the slots being formed for slidably receiving the at least one support frame.

19. The system as defined in claim 17 wherein the container includes at least one wall formed by two opposing parallel panels having a center layer therebetween.

20. The system as defined in claim 19 wherein the two opposing parallel panels are formed from a metallic composition.

21. The system as defined in claim 19 wherein the center layer is formed from a honeycomb construction.

22. A system for mounting fragile items, comprising:

a support panel, the support panel including a plurality of mounting holes thereon;

a support frame, the support panel being mounted in the support frame; and means for fastening at least one fragile item to the support panel, the fastening means including a bracket having a first end for attachment to the at least one fragile item, and a second end for attachment to the support panel and at least one securing member, the securing member being positioned within a mounting hole of the support panel for selectively retaining the second end of the bracket thereto so that the at least one fragile item may be shipped or stored on the support panel.

23. The system as defined in claim 22 wherein the second end of the bracket includes an opening formed therein permitting the securing member to pass therethrough when being positioned within the mounting hole of the support panel.

24. The system as defined in claim 23 wherein the securing member has a first end portion and a second end portion whereby the first end portion is formed to be positioned within a mounting hole of the support panel and the second end portion is formed to pass through the opening in the bracket when in an aligned position but will not pass therethrough when not in the aligned position.

25. The system as defined in claim 24 wherein the at least one fragile item is selectively secured to the support panel by placing the second end portion of the securing member into the aligned position so that the second end portion passes through the opening in the bracket and, upon rotating the second end portion, the second end portion is not aligned with the opening thereby retaining the second end portion in the bracket so that the at least one fragile item may be shipped or stored on the support panel.

26. The system as defined in claim 25 wherein the second end portion of the securing member is substantially T-shaped.

27. The system as defined in claim 26 wherein the bracket further includes a first pair of projections extending therefrom, adjacent the opening therein and spaced apart a distance substantially equivalent to a width of the T-shaped second end portion of the securing member, such that after the aligned T-shaped second end portion is passed through the opening and rotated so as not to be aligned with the opening, the T-shaped second end portion is positioned between the pair of projections such that the T-shaped second end portion is prevented from aligning with the opening in the bracket.

28. The system as defined in claim 27 further including a second pair of projections extending from the bracket, adjacent the opening therein and opposite the first pair of projections, the second pair of projections being spaced apart a width substantially equivalent to the width of the T-shaped second end portion of the securing member, such that after the aligned T-shaped second end portion is passed through the opening and rotated so as not to be aligned with the opening, the T-shaped second end portion is positioned between the second pair of projections such that the T-shaped second end portion is prevented from aligning with the opening of the bracket.

29. The system as defined in claim 22 wherein the first end of the bracket is pivotally coupled to the second end of the bracket.

30. An apparatus for mounting at least one fragile item, comprising:

a support panel;

a support frame, the support panel being mounted in the support frame, the support frame including a plurality of strap attachment fasteners mounted within mounting holes formed in the support frame;

at least one strap attached to the strap attachment fasteners for holding the fragile items on the support panel for shipping or storing the item and foam mounted on the support panel within the support frame, the foam being formed to substantially conform to an outline of the at least one fragile item.

31. The apparatus of claim 30 wherein the strap attachment fasteners are positioned on said panel for securing said foam thereto.

32. The apparatus of claim 30 further comprising a transparent cover attachable to the support frame allowing the fragile item to be viewed.

33. The apparatus of claim 30 wherein the support panel includes a plurality of mounting holes and the strap attachment fasteners extend through the support frame and the support panel.

34. The apparatus of claim 30 wherein each strap attachment fastener is substantially T-shaped.

35. A fastening device for attaching an item to a panel for storage or shipping, comprising:

a fastener member, the fastener member having first and second end portions, the first end portion being formed to pass through at least one opening formed in the panel;

a fastener securing member, the fastener securing member being formed to engage the first end portion of the fastener member so that the fastener member is retained in the panel after being passed through the at least one opening in the panel; and an item-attachment member for fixation to the item, the item-attachment member having an opening formed therein permitting the second end portion of the fastener member to pass therethrough and align with the opening in the item-attachment member and preventing the second end portion from passing therethrough when not aligned with the opening;

wherein the item is selectively secured to the panel by aligning the second end portion of the fastener member with the opening in the item-attachment member so that the second end portion passes through the opening and, upon rotating the second end portion, the second end portion is not aligned with the opening thereby retaining the second end portion in the item-attachment member so that the item may be shipped or stored on the panel.

36. The system as defined in claim 35 wherein the second end portion of the fastener member is substantially T-shaped.

37. The system as defined in claim 36 wherein the item-attachment member further includes a first pair of projections extending therefrom, adjacent the opening therein and spaced apart a distance substantially equivalent to a width of the T-shaped second end portion of the fastener member, such that after the aligned T-shaped second end portion is passed through the opening and rotated so as not to be aligned with the opening, the T-shaped second end portion is positioned between the pair of projections such that the T-shaped second end portion is prevented from aligning with the opening in the item-attachment member.

38. The system as defined in claim 37 further including a second pair of projections extending from the item-attachment member, adjacent the opening therein and opposite the first pair of projections, the second pair of projections being spaced apart a width substantially equivalent to the width of the T-shaped second end portion of the fastener member, such that after the aligned T-shaped second end portion is passed through the opening and rotated so as not to be aligned with the opening, the T-shaped second end portion is also positioned between the second pair of projections such that the T-shaped second end portion is prevented from aligning with the opening in the item-attachment member.

39. The system as defined in claim 35 wherein the item-attachment member has a first member and a second member, the first member having the opening formed therein for receiving the fastener member, the second member being fixed to the at least one fragile item, the first member being pivotally coupled to the second member.

40. A system for mounting fragile items, comprising:

a support panel, the support panel including a plurality of elongate mounting holes thereon;

a support frame, the support panel being mounted in the support frame; and an attachment bolt having an elongate head portion, said attachment bolt being mounted to said fragile item, wherein the fragile item is secured to said support panel by inserting said elongate head portion of said attachment bolt through an elongate hole and rotating the attachment bolt to be substantially normal to said elongate mounting hole.

* * * * *